US008636345B2

(12) United States Patent
Ogle et al.

(10) Patent No.: US 8,636,345 B2
(45) Date of Patent: Jan. 28, 2014

(54) SUPPLY TUBE CONNECTORS FOR CONNECTION WITH AN INK CONTAINER

(75) Inventors: Holli C. Ogle, Corvallis, OR (US); Francesc Ros Cerro, Sant Vicent de Montalt (ES); Martin Urrutia Nebreda, Barcelona (ES); Richard Lewis, Barcelona (ES); Marc Bautista Palacios, Sant Dugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 222 days.

(21) Appl. No.: 12/949,782

(22) Filed: Nov. 19, 2010

(65) Prior Publication Data

US 2011/0062699 A1 Mar. 17, 2011

Related U.S. Application Data

(63) Continuation of application No. PCT/US2008/064080, filed on May 19, 2008.

(51) Int. Cl.
*B41J 2/17* (2006.01)
*B41J 2/175* (2006.01)

(52) U.S. Cl.
USPC ..... 347/84; 347/85; 347/86

(58) Field of Classification Search
USPC ..... 347/84, 85, 86
See application file for complete search history.

(56) References Cited

U.S. PATENT DOCUMENTS

| | | | | |
|---|---|---|---|---|
| 4,703,989 | A | 11/1987 | Price et al. | |
| 5,980,032 | A | 11/1999 | Pawlowski | |
| 6,024,441 | A | 2/2000 | Nishimoto | |
| 6,286,949 | B1 | 9/2001 | Lewis et al. | |
| 6,631,982 | B2 | 10/2003 | Sasaki et al. | |
| 6,834,945 | B2 | 12/2004 | Ishizawa | |
| 6,874,876 | B2 | 4/2005 | Ishizawa | |
| 7,380,909 | B2 | 6/2008 | Ishizawa | |
| 2005/0265736 | A1 * | 12/2005 | Seto et al. | 399/13 |
| 2006/0071985 | A1 | 4/2006 | Therien | |
| 2006/0096307 | A1 | 5/2006 | Coogle | |

FOREIGN PATENT DOCUMENTS

| | | |
|---|---|---|
| EP | 0317342 | 5/1989 |
| EP | 1053881 | 11/2000 |
| JP | 2002-113881 | 4/2002 |
| JP | 2002-307713 | 10/2002 |

OTHER PUBLICATIONS

PCT/US2008/064080: PCT Written Opinion of the Internatonal Searching Authority.
EP Search Report dated Apr. 4, 2011.

* cited by examiner

*Primary Examiner* — Jannelle M Lebron

(57) ABSTRACT

A connector for connecting to an ink container. In one embodiment, the connector includes a housing that defines an interior space, a latch lever pivotally mounted to the housing that is adapted to secure the connector to the ink container, and an internal switch provided within the interior space of the housing, the internal switch being configured to send a signal to a printer associated with the ink container when the switch is tripped, wherein the internal switch is tripped when the latch lever is pivoted by a user during disconnection of the connector from the ink container but before the connector is in fact disconnected.

12 Claims, 4 Drawing Sheets

SUPPLY TUBE CONNECTORS FOR CONNECTION WITH AN INK CONTAINER

CROSS-REFERENCE TO RELATED PATENT APPLICATIONS

The present application is a continuation of co-pending PCT/US2008/064080 filed on May 19, 2008 by Holli C. Ogle, Francesc Ros Cerro, Martin Urrutia Nebreda, Richard Lewis and Marc Bautista Palacios, and entitled SUPPLY TUBE CONNECTORS FOR CONNECTION WITH AN INK CONTAINER, the full disclosure of which is hereby incorporated by reference

BACKGROUND

Ink is often supplied to large format printers with independent ink containers. Ink typically flows from each container through a supply tube that extends from the ink container to the print mechanism of the printer. The supply tube and the ink container are normally connected with a supply tube connector that can be connected to and disconnected from the ink container by a user.

It may be important for the printer to "know" when the user is about to disconnect the supply tube connector from the ink container. Although the user could be required to manually signal the printer each time he or she is about to disconnect the connector, a more automatic means of determining that disconnection is about to occur would be preferable.

BRIEF DESCRIPTION OF THE DRAWINGS

The disclosed supply tube connectors can be better understood with reference to the following drawings. The components in the drawings are not necessarily to scale.

DETAILED DESCRIPTION

Disclosed herein are supply tube connectors that facilitate detecting when the connector is about to be disconnected from an ink container. In some embodiments, a supply tube connector comprises an internal switch that is triggered when a user begins to remove the connector from the ink container. The switch is triggered by an internal toggle member that is biased toward an internal button associated with the switch.

When a latch lever of the connector that secures the connector to the ink container is pressed by the user as the user begins to disconnect the connector, support for the toggle member is removed and the toggle member is moved into contact with the button, thereby tripping the switch.

Figure 1:
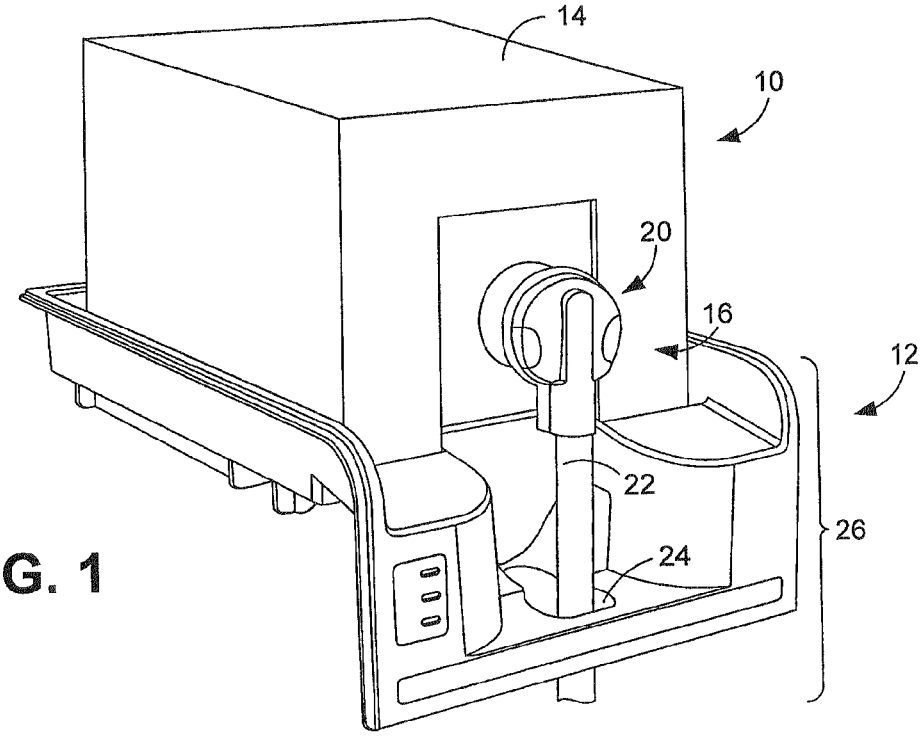
FIG. 1 is a perspective view of an ink container and a supply tube connector that is connected to the ink container.
Figure 2:
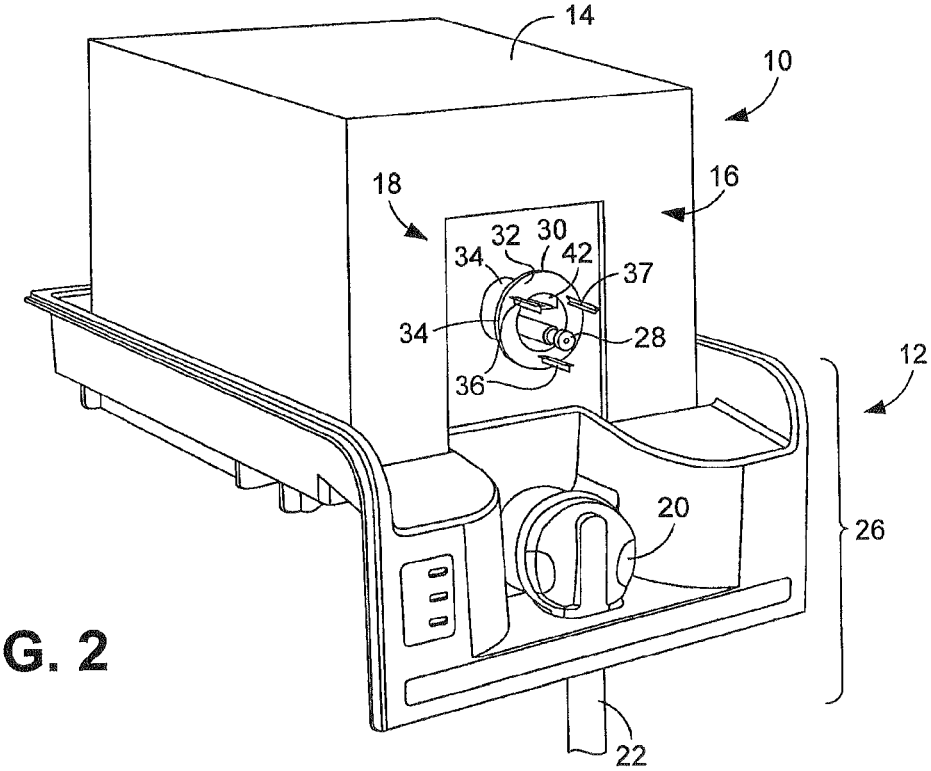
FIG. 2 is a further perspective view of the ink container and the supply tube connector of FIG. 1, with the supply tube connector shown disconnected from the ink container.

Referring now in more detail to the figures, in which like numerals identify corresponding parts throughout the views, FIGS. 1 and 2 illustrate a bag-in-box ink container 10 supported by an ink container support 12. As is apparent from FIGS. 1 and 2, the ink container 10 comprises a box-shaped outer carton 14, which contains an internal ink containment bag (not visible). In some embodiments, the carton 14 is constructed of a corrugated fiberboard material, commonly referred to as cardboard. Irrespective of the material from which it is made, the carton 14 comprises multiple sides, including a front side 16 at which an ink container connector 18 (FIG. 2) can be accessed.

In FIG. 1, a supply tube connector 20 is shown connected to the ink container connector 18 such that ink contained within the internal ink containment bag can flow out from the container 10, through the connector, and into a supply tube 22 on which the supply tube connector is mounted. More particularly, the ink can flow through an internal ink tube (not shown) provided within the supply tube 22. The supply tube 22 leads to a print mechanism of a printer (not shown) to which the ink is to be provided. An example embodiment of the supply tube connector 20 is described below in relation to FIGS. 3-5. As is further shown in FIG. 1, the supply tube 22 can extend down from the supply tube connector 20 and pass through an aperture 24 provided within a front panel 26 of the support 12. In FIG. 2, the supply tube connector 20 is shown disconnected from the ink container connector 18 and supported by the front panel 26 of the support 12.

With further reference to FIG. 2, the ink container connector 18 comprises an outlet port 28 from which ink can flow. Surrounding the port 28 is a flange or collar 30 that includes a planar outer surface 32 and a circular peripheral edge 34 that can be gripped by the supply tube connector 20. Extending outward from the surface 32 are posts 36, 37 that provide color and family keying between the supply tube connector 20 and the ink container connector 18. As is further shown in FIG. 2, extending inward from the collar 30 is a neck 40 that passes through the carton 14 and attaches to the internal fluid containment bag. Extending inward into the surface 32 is a recess 42 in which is provided is a memory element, such as a memory chip, is mounted (not shown).

Figure 3:
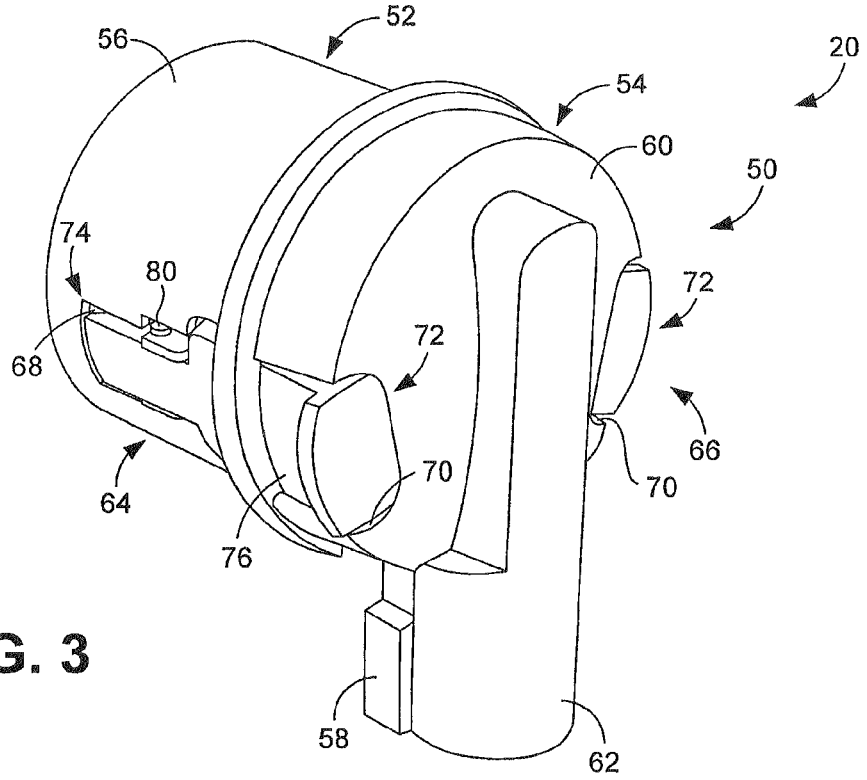
FIG. 3 is a first perspective view of an example embodiment for the supply tube connector shown in FIG. 1.
Figure 4:
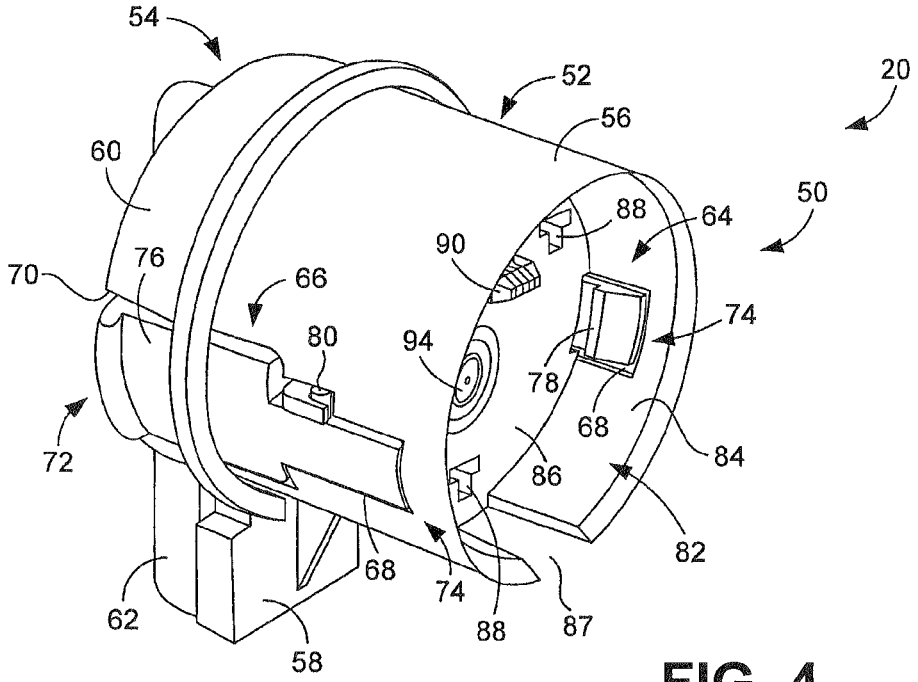
FIG. 4 is a second perspective view of the supply tube connector of FIG. 3.
Figure 5:
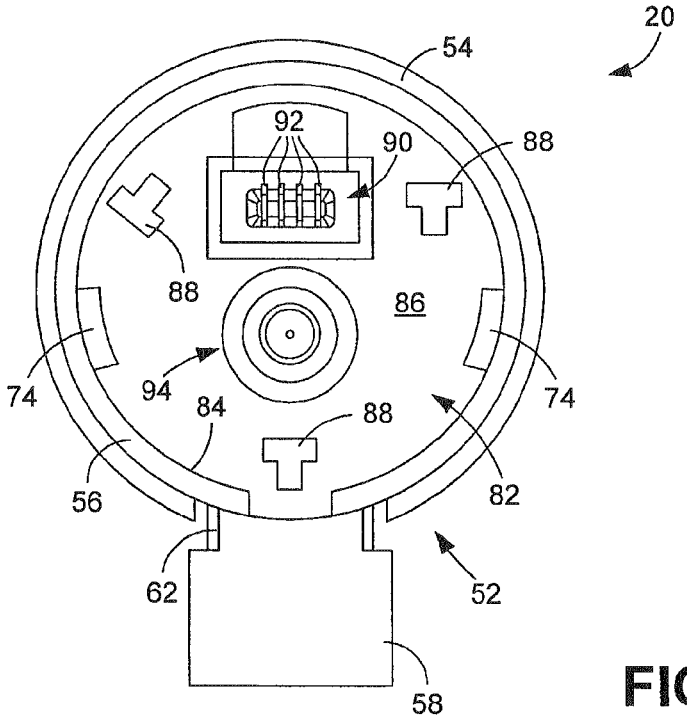
FIG. 5 is an end view of the supply tube connector of FIG. 3.

FIGS. 3-5 illustrate an example configuration for the supply tube connector 20. Beginning with FIGS. 3 and 4, the supply tube connector 20 includes an outer housing 50 that is defined by a connector body 52 and a connector cap 54 that is removably attached to the body. By way of example, the connector cap 54 is snap-fit to the connector body 52. The connector body 52 includes a cylindrical portion 56 and a neck portion 58 that extends perpendicularly downward from the cylindrical portion. The connector cap 54 comprises a generally cup-shaped body portion 60 that encloses a rear end of the cylindrical portion 56 of the connector body 52, and a partially cylindrical neck portion 62 that is connected to the neck portion 58 of the connector body.

With further reference to FIGS. 3 and 4, the supply tube connector 20 further comprises first and second latch levers 64 and 66. As indicated in FIGS. 3 and 4, both the cylindrical portion 56 of the connector body 52 and the body portion 60 of the connector cap 54 comprise openings 68 and 70 that provide room for and enable operation of the latch levers 64, 66.

Figure 6:
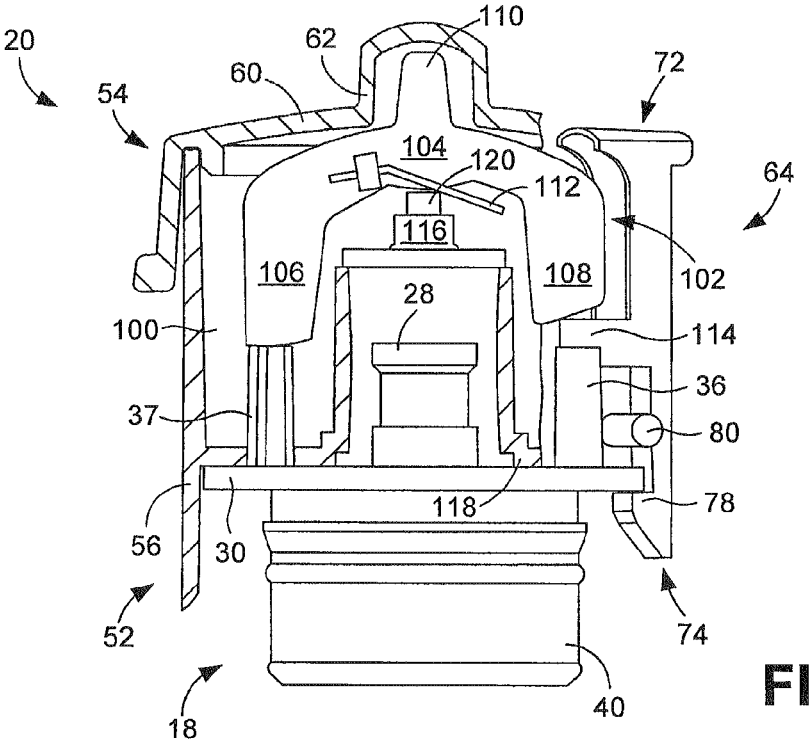
FIG. 6 is a partial cross-sectional view of the supply tube connector of FIG. 3, with the supply tube connector shown connected to an ink container connector.

As is also indicated in FIGS. 3 and 4, and further illustrated in FIG. 6 described below, each latch lever 64, 66 is elongated and comprises a first or proximal end 72 and a second or distal end 74. The proximal ends 72 each define a pushbutton surface 76 that can be pressed inward by the user, for example using the thumb and index finger. Therefore, the proximal ends 72 of latch levers 64, 66 can pinched inward by the user at least when the user is disconnecting the supply tube connector 20 from the ink container connector 18. The distal end 74 of each latch lever 64, 66 defines a latch element 78 that, as shown most clearly in FIG. 6, is adapted to grip the peripheral edge 34 of the collar 30 of the ink container connector 18.

Positioned between the proximal and distal ends 72, 74 of each latch lever 72 is a pivot element or shaft 80 that defines a pivot axis about which the latch lever can pivot. Therefore, when the pushbutton surfaces 76 of the latch levers 64, 66 are pushed inward towards each other, the distal ends 74 of the latch levers, and their latch elements 78, are displaced outward (see FIG. 7A). Each latch lever 64, 66 is preferably biased toward the position illustrated in FIGS. 3 and 4 with internal springs (not shown) that oppose depression of the pushbutton surfaces 76 such that the distal ends 74 of the latch levers and their latch elements 78 are inwardly biased.

With reference next to FIGS. 4 and 5, the cylindrical portion 56 of the connector body 52 forms an inner cylindrical recess 82 defined by a peripheral wall 84 that extends outward from an inner wall 86. As is shown most clearly in FIG. 4, the peripheral wall 84 comprises a notch 87 that facilitates alignment of the supply tube connector 20 with the ink container connector 18. Formed within the inner wall 86 are multiple post openings 88 that are adapted to receive the posts 36, 37 of the ink container connector 18. Extending out from the inner wall 86 is an electrical connector 90 that is adapted for receipt by the recess 42 of the ink container connector 18. The electrical connector 90 comprises electrical contacts 92 that are configured to make contact with the memory element of the ink container 10 when the supply tube connector 20 is coupled with the ink container connector 18 so as to facilitate communication between printer and the ink container. In some embodiments, the electrical connector 90 is coupled with one or more electrical conductors such as wires or a cable (not shown) that extend from the supply tube connector 20 and through the supply tube 22 to control logic of the printer.

As is further illustrated in FIGS. 4 and 5, the supply tube connector 20 also comprises a fluid interconnect 94 adapted to couples with the outlet port 28 of the ink container connector 18. In some embodiments, the fluid interconnect 94 is connect to an internal ink tube (not shown) of the supply tube 22 through which ink is delivered to the print mechanism.

Referring next to FIG. 6, the supply tube connector 20 is shown coupled with the ink container connector 18. In FIG. 6, only a portion of the supply tube connector 20 is shown for the sake of clarity. In particular, the right portion (in the orientation of FIG. 6) of the supply tube connector 20 has been cut away to more clearly show the latch lever 64. Furthermore, the other latch lever 66 has been omitted to more clearly show coupling between the supply tube connector 20 and the ink container connector 18.

As illustrated in FIG. 6, the cylindrical portion 56 of the connector body 52 and the body portion 60 of the connector cap 54 define an interior space 100. Disposed within the interior space 100 is an internal toggle member 102 that comprises a body portion 104 from which extend first and second leg portions 106 and 108 in a first or inward direction and a stop element 110 in a second, opposite or outward direction. The toggle member 102 is biased inward (downward in the orientation of FIG. 6) by a spring 112 that is attached to the body portion 104 of the member and to the supply tube connector 20. The toggle member 102 is supported in the orientation shown in FIG. 6 by both the ink container connector 18 and the latch lever 64. In particular, the first leg portion 106 of the toggle member 102 is supported by the post 37 of the ink container connector 18, and the second leg portion 108 is supported by a support element 114 of the latch lever 64.

Positioned immediately adjacent the portion body 104 of the toggle member 102 is a switch 116 that is mounted on an internal column 118 of the connector body 52. The switch 116 includes a pushbutton 120 that, when pressed, trips the switch and sends a signal to the printer control logic. That signal indicates to the printer control logic that the supply tube connector 20 is either disconnected from the ink container connector 18 (see FIG. 7B) or is about to be disconnected from the ink container connector (see FIG. 7A). Notably, when the supply tube connector 20 is connected to the ink container connector 18 and the switch 116 is not tripped, proper connection of the supply tube connector to the ink container connector is signaled to the printer control logic.

Figure 7A:
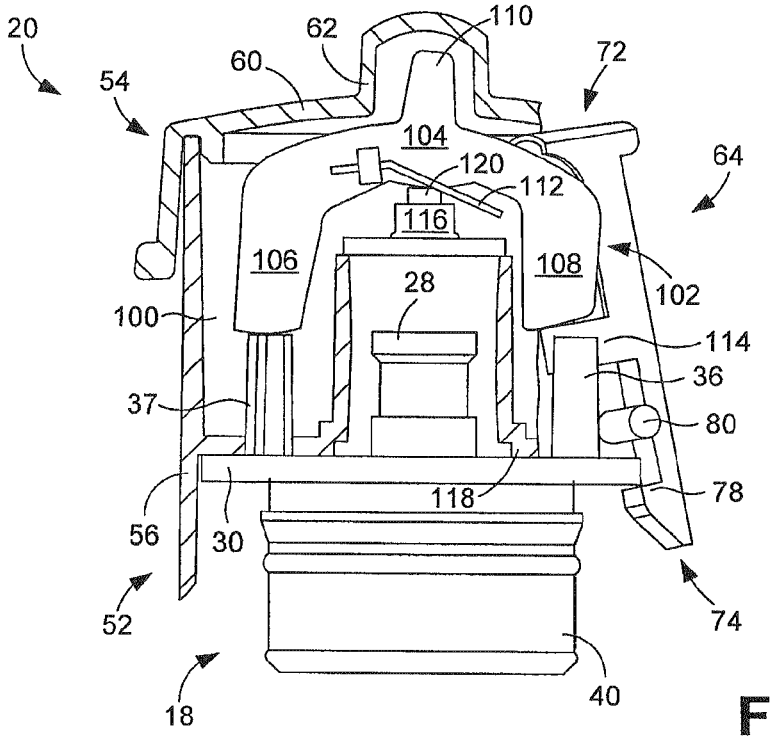
FIG. 7A is a further partial cross-sectional view of the supply tube connector and the ink container connector of FIG. 6, illustrating a first orientation of an internal toggle member of the supply tube connector.
Figure 7B:
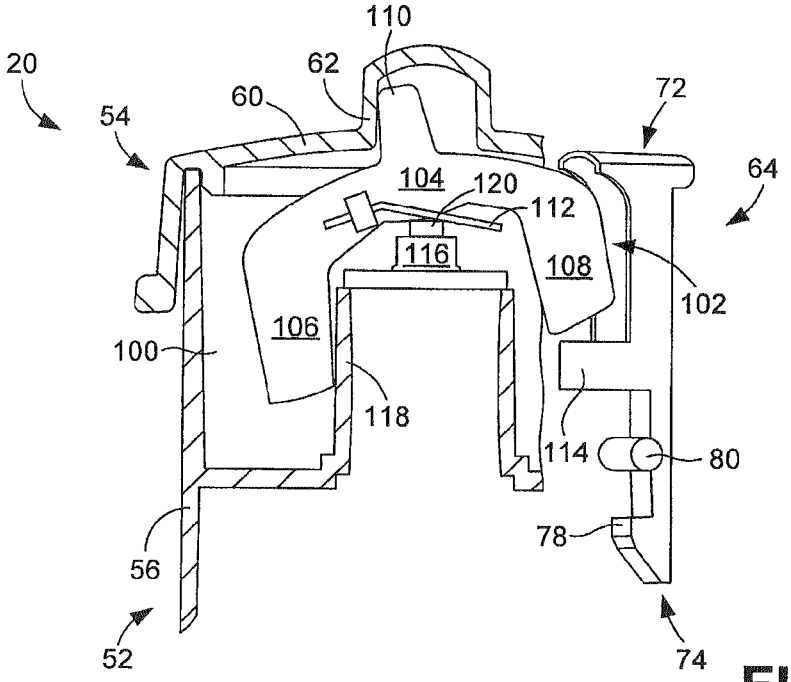
FIG. 7B is a further partial cross-sectional view of the supply tube connector shown in FIG. 6, illustrating a second orientation of the internal toggle member of the supply tube connector.

FIGS. 7A and 7B illustrate two conditions or situations in which the switch 116 is tripped. Beginning with FIG. 7A, illustrated is tripping of the switch 116 in response to depression of the latch lever 64 by a user when the user is in the process of disconnecting the supply tube connector 20 from the ink container connector 18. As indicated in FIG. 7A, the proximal end 72 of the latch lever 64 has been moved inward, for example due to force provided by the user's thumb or index finger. Because the latch lever 64 is pivotally mounted to the supply tube connector 20 with the pivot shaft 80, inward movement of the proximal end 72 causes outward movement of the distal end 74 release of the latch element 78 from the collar 30 of the ink container connector 18. As shown in FIG. 7A, however, the latch lever 64 has not yet been pivoted to the extent at which the latch element 78 no longer grips the collar 30. As a result, the supply tube connector 20 is still connected to the ink container connector 18 and, therefore, the electrical connector 90 (FIGS. 4 and 5) is still electrically coupled with the memory element of the ink container connector.

Although not enough to disconnect the supply tube connector 20 from the ink container connector 18, the pivoting of the latch lever 64 causes the toggle member 102 to toggle. In particular, because the toggle member 102 is inwardly biased and is partly supported against that bias by the support element 114, of the latch lever 64 the second leg portion 108 shifts inward (downward in the orientation of FIG. 7A) as the support element is moved inward due to the pivoting. As a consequence, the body 104 of the toggle member 102 is pressed in upon the button 120 by the spring 112 and therefore trips the switch 116. As mentioned above, tripping of the switch causes a signal to be sent to the printer and, more particularly, the printer control logic. Notably, the signal need not comprise and affirmatively transmitted signal. Instead, the "signal" can comprise the breaking of an active connection between the supply tube connector 20 and the printer. After receiving the signal, the printer can perform various tasks that may be important to complete before and/or while the supply tube connector 20 is disconnected from the ink container 10. Such tasks can include the closing one or more valves to halt the flow of ink. Furthermore, the tasks can include the cessation of communications with the memory element of the ink container in cases in which disconnection during active communications can cause an error. In some systems, disconnection during writing to or reading from the memory element can cause a fatal error that renders the ink container 10 unusable.

FIG. 7B illustrates a second condition or situation in which the switch 116 is tripped. More particularly, FIG. 7B illustrates tripping of the switch 116 when the supply tube connector is no longer connected to the ink container connector 18. As indicated FIG. 7B, the first leg portion 106 of the toggle member 102 has shifted inward (downward in the orientation of FIG. 7B) due to the biasing of the spring 112 and the removal of the support of the post 37 (compare FIG. 6). As a consequence of that shifting, the body 104 of the toggle member 102 is pressed inward upon the button 120 by the spring 112 and therefore trips the switch 116. As before, tripping of the switch 116 sends a signal to the printer control logic to identify the disconnected (or about to be disconnected) condition. As is further indicated in FIG. 7B, shifting of the toggle member 102 is limited by the stop element 110, which abuts the interior of the neck portion 62 of the connector cap 54.

Claimed are:

1. A connector for connecting to an ink container, the connector comprising:

a housing that defines an interior space;

a latch lever pivotally mounted to the housing that is adapted to secure the connector to the ink container; and an internal switch provided within the interior space of the housing, the internal switch being configured to send a signal to a printer associated with the ink container when the switch is tripped, wherein the internal switch is tripped when the latch lever is pivoted by a user during disconnection of the connector from the ink container but before the connector is in fact disconnected.

2. The connector of claim 1, wherein the housing comprises a connector body and a connector cap that encloses an end of the connector body and wherein the latch lever is pivotally mounted to the connector body.

3. The connector of claim 1, wherein the latch lever includes a proximal end, a distal end, and a pivot shaft positioned between the two ends, wherein the proximal end forms a pushbutton surface that can be pushed inward by the user and wherein the distal end forms a latch element adapted to grip a connector of the ink container.

4. The connector of claim 1, wherein the internal switch comprises a button that is pressed to trip the switch.

5. The connector of claim 1, further comprising an electrical connector adapted to couple with a memory element of the ink container.

6. The connector of claim 1, further comprising an internal toggle member provided within the interior space of the housing, the toggle member being adapted to trip the switch when the latch lever is pivoted.

7. The connector of claim 6, further comprising an internal spring provided within the interior space of the housing that biases the toggle member toward the switch.

8. The connector of claim 7, wherein the toggle member is supported against the biasing of the spring by a support element of the latch lever such that when the support of the support element is removed due to pivoting of the latch lever, the toggle member shifts toward the switch.

9. The connector of claim 8, wherein the toggle member comprises a body portion and first and second leg portions that extend from the body portion and wherein the support element of the latch lever supports the second leg portion.

10. The connector of claim 9, wherein the first leg portion of the toggle member is adapted to be supported by an element of the ink container when the connector is connected to the ink container such that the toggle trips the switch when the connector is not connected to the ink container.

11. The connector of claim 1 further comprising:

a second latch lever pivotally mounted to the housing, wherein the latch lever and the second latch lever each include a proximal end, a distal end, and a pivot shaft about which the latch lever can pivot, the proximal end forming a pushbutton surface that can be pushed inward by the user and the distal ends forming latch elements that can grip a collar of the ink container connector to secure the supply tube connector to the ink container connector, wherein the internal switch includes a button that trips the switch when pressed; and an internal toggle member provided within the interior space of the housing, the internal toggle member being adapted to press the button of the switch when the latch lever is pivoted such that the switch is tripped when the latch lever is pivoted by a user during disconnection of the supply tube connector from the ink container connector but before the supply tube connector is in fact disconnected.

12. The connector of claim 11, wherein the toggle member is supported against the biasing of the spring by a support element of one of the latch lever and a second latch lever such that when the support of the support element is removed due to pivoting of the latch lever, the toggle member depresses the button of the switch.

* * * * *